US005775006A

United States Patent [19]

Breuner

[11] Patent Number: 5,775,006

[45] Date of Patent: Jul. 7, 1998

[54] INSULATED WINTER WEATHER BOOT HAVING AN ADJUSTABLE STRAP CLOSURE

[75] Inventor: Richard W. Breuner, Truckee, Calif.

[73] Assignee: Truckee Winter Sports, Inc., Truckee, Calif.

[21] Appl. No.: 874,904

[22] Filed: Jun. 16, 1997

Related U.S. Application Data

[63] Continuation of Ser. No. 358,063, Dec. 14, 1994, abandoned.

[51] Int. Cl.[6] ..... A43C 11/00; A43B 7/20; A43B 23/00

[52] U.S. Cl. ..... 36/50.1; 36/89; 36/45

[58] Field of Search ..... 36/50.1, 88, 89, 36/7.1 R, 7.5, 1.5, 2 R, 54, 45, 114

[56] References Cited

U.S. PATENT DOCUMENTS

| | | | |
|---|---|---|---|
| D. 64,104 | 2/1924 | Kezy . | |
| D. 94,755 | 3/1935 | Grossman . | |
| 177,396 | 5/1876 | Harris . | |
| D. 343,277 | 1/1994 | Richard et al. . | |
| 796,258 | 8/1905 | Scott . | |
| 2,071,593 | 2/1937 | Thormann . | |
| 2,285,993 | 6/1942 | Marsh et al. | 36/50.1 |
| 2,334,133 | 11/1943 | Shields . | |
| 2,426,403 | 8/1947 | Margulis | 36/50.1 |
| 2,494,964 | 1/1950 | Rome . | |
| 3,408,752 | 11/1968 | Löllman . | |
| 4,377,913 | 3/1983 | Stone | 36/50.1 X |
| 4,736,531 | 4/1988 | Richard | 36/554 |
| 4,845,864 | 7/1989 | Corliss | 36/131 |
| 4,989,350 | 2/1991 | Bunch et al. | 36/89 |
| 5,150,536 | 9/1992 | Strong | 36/7.1 R |
| 5,243,772 | 9/1993 | Francis et al. | 36/114 |
| 5,269,078 | 12/1993 | Cochrane | 36/93 |
| 5,317,820 | 6/1994 | Bell et al. | 36/89 |
| 5,392,535 | 2/1995 | Van Noy et al. | 36/50.1 X |
| 5,408,761 | 4/1995 | Gazzano | 36/114 X |
| 5,465,509 | 11/1995 | Fuerst et al. | 36/88 |

FOREIGN PATENT DOCUMENTS

| | | | |
|---|---|---|---|
| 0212032 | 3/1987 | European Pat. Off. | 36/88 |

*Primary Examiner*—B. Dayoan
*Attorney, Agent, or Firm*—Burns, Doane, Swecker & Mathis, L.L.P.

[57] ABSTRACT

A winter weather footwear article is disclosed which is formed of a molded sole, a flexible and foot-conformable upper attached to the top surface of the molded sole, and sandal strapping coupled to the sole or the upper and tightenable and fastenable about the exterior of the upper to set the tightness of fit of the article to the wearer's foot. The upper is made up of a fabric layer having a flexible and foot-conformable layer of closed cell polymer foam laminated to the interior surface. This article is preferably used in combination with an inner liner made of a soft insulative material. In preferred embodiments, the upper includes a fabric layer with a flexible and foot-conformable layer of closed cell polymer foam laminated to the interior surface of the fabric layer. The upper also may include a layer of continuous support material affixed to the molded sole and to the exterior surface of the fabric layer, extending around the perimeter of the article to a height at least about midway up the side of the wearer's foot. The sandal strapping preferably includes struts affixed to the molded sole and extending upward adjacent to the area of the upper which contacts the ankle, a first adjustable strap connecting the two struts across the heel, and a second adjustable strap affixed to the medial side support extending through an aperture in the lateral side support, extending through an aperture in the medial strut, and then coupled to the lateral strut with coupling means.

21 Claims, 2 Drawing Sheets

INSULATED WINTER WEATHER BOOT HAVING AN ADJUSTABLE STRAP CLOSURE

This application is a continuation of application No. Ser. No. 08/358,063, filed Dec. 14, 1994, now abandoned.

BACKGROUND OF THE INVENTION

1. Field of the Invention

This invention relates to footwear and more particularly to a winter weather boot capable of providing substantial thermal and wet weather protection to the wearer while achieving substantial comfort and ease of wearing.

2. Description of Prior Art

Winter outdoor footwear has evolved into several distinct categories. There are purpose-built shoes and boots, for example ski boots, designed for particular sporting activities. These shoes and boots tend to be closely fitted to the wearer's foot to provide accurate motion control and support for the foot and ankle during a particular sporting activity. Examples of such footwear include the ski boots shown in U.S. Pat. No. 3,408,752 of Paul Lollmann, U.S. Pat. No. 2,071,593 of Wilhelm Thormann and U.S. Pat. No. 2,494,964 of Leon Rome.

There is a second category of winter boot. These boots are generally made of leather or molded rubber and are designed to provide a moisture barrier and/or insulation against cold. These general purpose outdoor weather boots are either worn over shoes or directly over the wearer's foot. Winter boots of this type are worn in an environment which presents a wide range of conditions. These include terrain that may be frozen solid and abrasive or may be soft and sloppy. Conditions may be wet or dry. Temperatures can range from 60°–70° F. down to many degrees below zero. The wearer may be relatively immobile or may be traversing substantial distances.

Boots of this type, designed and marketed here-to-fore, have generally not been well fitted to the wearer's foot. This is due in part to their general style of construction and to their being sized to accommodate variable numbers and thicknesses of layers of heavy sock or various felt or woven insulating liners. In addition, their design is driven by their primary objectives of providing moisture and thermal protection in the wide range of foul weather settings encountered in winter conditions. An accurate fit and substantial degrees of foot and ankle support are not high priorities. A recent example of such a winter boot is shown in U.S. Pat. No. 5,150,536 of Molly Strong.

In addition, the designs of these prior winter weather boots have made compromises in other areas of the design environment. These compromises are seen in terms of the boots' shortcomings when dealing with the other conditions encountered in harsh winter weather, for example the different sources of wetness, abrasiveness and differences in terrain and terrain texture. These prior boots also fall short in terms of wearability and comfort among the range of activity levels and varying needs for agility and grace and traction acquired by different wearers in differing winter settings.

The winter weather boot described herein employs a criss-cross or "Z" strap closure of particular configuration. "Z" straps of various types have been used with footwear in the past. See, for example U.S. Pat. No. Des. 94,755 of Nicholas Grossman and U.S. Pat. No. 5,269,078 of Charles Cochrane. Footwear with other strap designs are shown in U.S. Pat. No. 177,396 of Philip Harris, et al, U.S. Pat. No. 796,258 of Rossiter Scott, U.S. Pat. No. 2,071,593 of Wilhelm Thormann, U.S. Pat. No. 4,845,864 of William Corliss, U.S. Pat. No. 4,901,451 of Christophe Cumin, U.S. Pat. No. 5,317,820 of Anthony Bell, et al, U.S. Pat. No. Des 64,104 of Eugene Kezy, and U.S. Pat. No. Des 343,277 of Daniel Richard, et al.

Another aspect of this invention concerns the use of an overlaying tongue as protection and insulation. Representative patents which disclose overlaying tongues in footwear include U.S. Pat. No. 2,334,133 of Francis Shields and U.S. Pat. No. 4,845,864 of William Corliss.

STATEMENT OF THE INVENTION

It is an object of the present invention to provide a new category of winter outdoor footwear. The present invention provides a footwear system that can be worn in the wide range of winter weather settings. This footwear system is characterized by providing a substantial degree of foot and ankle support while at the same time providing a high degree of winter weather protection and comfort. It is useful throughout the winter environment whether bitter cold and frozen solid or more temperate and soft and slushy. It can withstand abuse and abrasion. It is light in weight and easy to put on. It achieves a higher degree of agility, sure-footedness and wearability than possible with winter footwear products available heretofore.

In one aspect the footwear system is characterized by having a durable waterproof fabric boot upper with a adhered closed cell polymer (rubber or plastic) foam backing. This closed cell foam-backed upper is adhered to a molded sole. The system also includes a external adjustable sandal strapping network which locks the boot on the wearer's foot. The overall system may include a removable, soft, foot-conforming liner fittable within the boot itself. This liner is made of felted, knit or woven material.

In other aspects the molded sole is plastic and/or rubber and the exterior sandal strapping network may be characterized by the use of a "Z" strap arrangement with a strap crossing back and forth across the vamp of the boot. This works for quickly and efficiently closing the boot about the wearer's foot while achieving a good level of tightness and support about the wearer's foot together with high levels of comfort and wearability.

In a further aspect the boot preferably includes a pair of vertically mounted struts or yokes located laterally and medially in the ankle region of the boot. These struts are joined to the molded sole and provide lateral and medial support to the wearer's ankle. A back strap or the like attachment joins these struts across the back of the wearer's ankle. The tightenable Z strap threads through apertures on these struts so as to allow the boot to be tightened about the wearer's foot and ankle and provide superior degrees of fit and sure-footedness.

In a yet further aspect, the boot can have at least one additional strap closing and fitting the top of the upper about the wearer's ankle and lower leg.

In addition, the boot of this invention can have an overlaying, gauntlet-style tongue which is held in place by the various straps (and optionally hook and loop fasteners) and provides temperature and snow protection.

Thus, in one embodiment this invention provides a winter weather footwear system which includes a boot with an inner liner. The inner liner is made of a soft insulative material and is shaped to conform to the wearer's foot and ankle. The boot into which the liner is fitted has a molded sole adhered to a flexible and wearer-foot-conformable fabric upper having a closed cell foam backing. The flexible upper has a vamp that is expandable or openable to permit insertion of the wearer's foot into the boot and its inner liner. It also has a tongue overlaying and protecting the vamp. The boot has lateral and medial struts or yokes affixed to the molded sole. These struts extend upward adjacent to the areas of the upper which contact the wearer's ankle when the system is being worn. These struts are made of resilient plastic of a firmness adequate to firmly support the wearer's foot when the system is being worn. The boots also can have a layer of a continuous material affixed to the outside of the fabric upper. This layer can take the form of lateral and medial side walls affixed to the molded sole. These sidewalls extend upward to a point at least about equal to the midpoint of the height of the wearer's foot and extend at least forward from the lateral and medial struts respectively to a point corresponding to about the ball of the wearer's foot. If desired this sidewall of continuous material can surround the perimeter of the boot.

These sidewalls conform to the upper but have greater resilience than the upper and thus provide shape to the upper and impact and abrasion protection to the wearer's foot and to the boot. The boot is held to the wearer's foot with a particularly configured set of external sandal straps which overlay the upper. These straps are referred to as "sandal straps" because in appearance they resemble the straps found on some types of sandals and beach footwear. The first strap or connector connects the two struts across the heel. It can be tightenable. The second strap is a "Z" strap. It is affixed to the medial side support at the point corresponding to the ball of the wearer's foot. It extends through an aperture in the lateral side support at a point also corresponding to the ball of the wearer's foot and then extends through an aperture in the front of the medial strut and then couples to the front of the lateral strut. The length of the second strap is adjustable to set the tightness of fit of the system to the wearer's foot. In preferred configurations for the boot of this invention a third strap is present. This is a simple adjustable strap which fits through loops or other apertures in the boot upper and goes around the top of the boot above the ankle. This strap is fastened and tightened to close the tongue of the boot close to the ankle and to prevent snow and cold from reaching the inside of the boot.

DETAILED DESCRIPTION OF THE INVENTION

BRIEF DESCRIPTION OF THE DRAWINGS

This invention will be further described with reference being made to the drawings in which.

DESCRIPTION OF PREFERRED EMBODIMENTS

Figure 1:
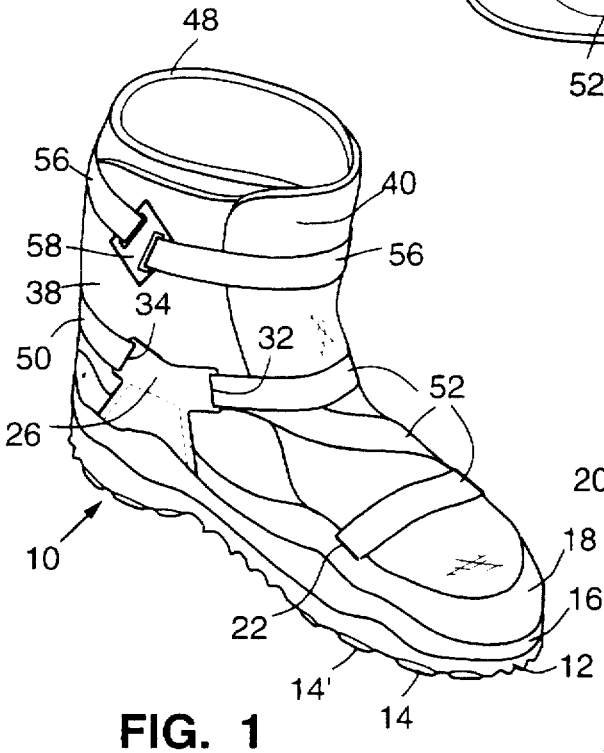
FIG. 1 is a perspective medial view of a left foot boot of the invention.
Figure 3:
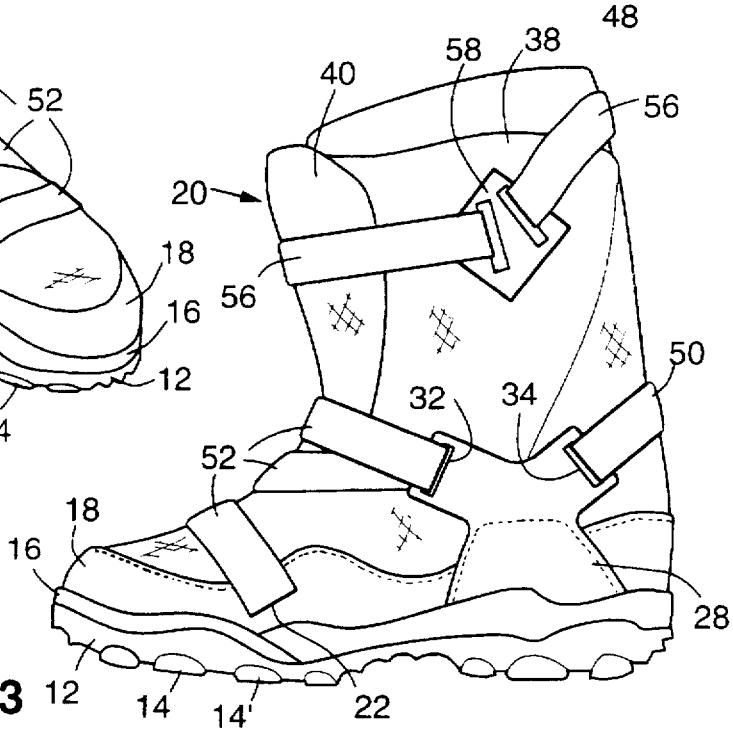
FIG. 3 is a medial side view of the boot of FIG. 2.
Figure 4:
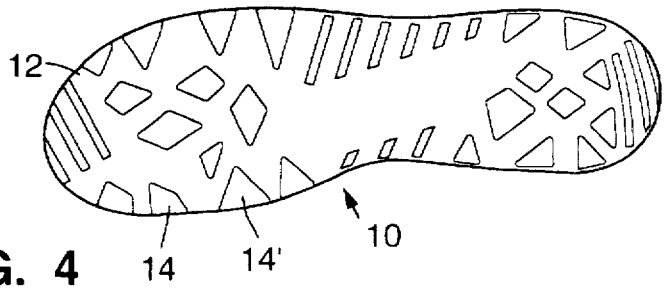
FIG. 4 is a bottom view of the boot of FIG. 1.

Turning to FIGS. 1 through 7 simultaneously, it will be seen that the same reference numeral is used throughout the drawings when referring to the same part. FIGS. 1 and 4 show a left hand boot 10 and the remaining FIGS. depict a right hand boot 20. Both boots include an outer sole 12 or 12'. This sole is a molded sole made out of plastic or rubber. This material should be waterproof and flexible so that the boot will flex when it is being warn. This material of construction may be selected from the moldable olefin polymers, urethane polymers or the like which find common application in molded footwear outsoles. Sole 12 or 12' has a lugged design with lugs 14, 14', etc providing good traction on wet surfaces as well as on frozen, snowy surfaces and the like.

Figure 6:
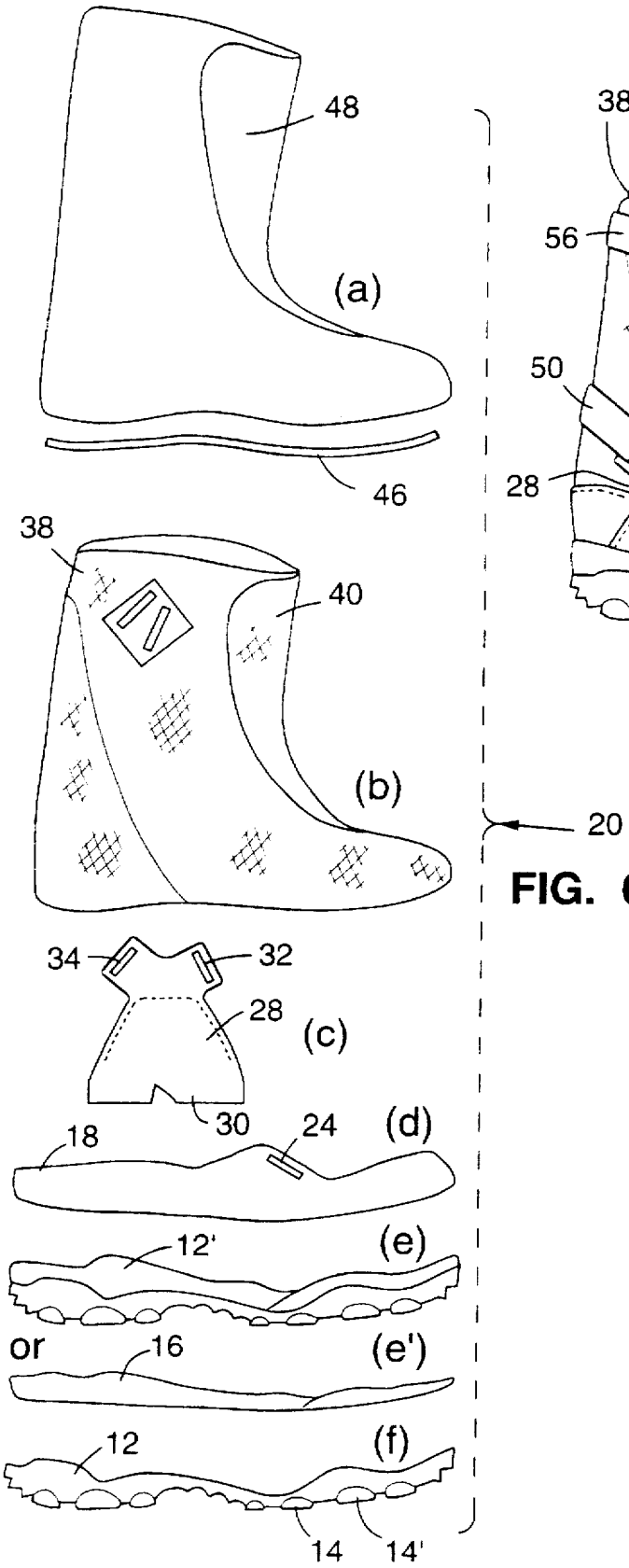
FIG. 6 is an exploded lateral side view of boot of FIG. 2 showing alternative embodiments of the sole structure.
Figure 5:
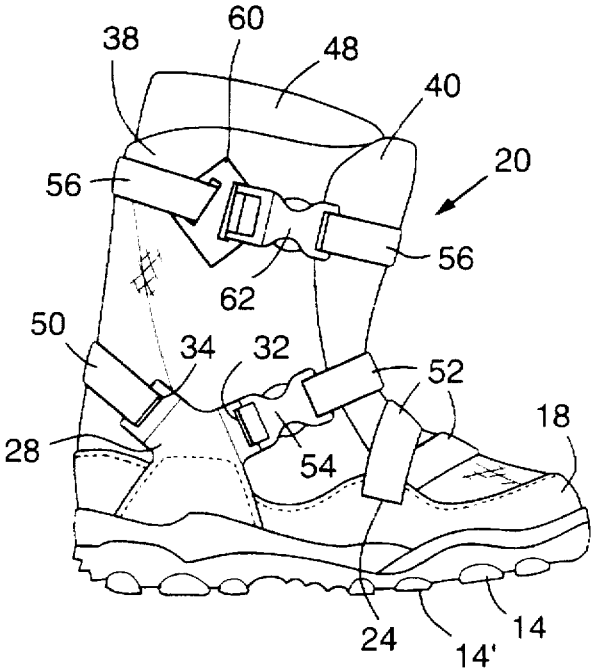
FIG. 5 is a lateral side view of the boot of FIG. 2.
Figure 7:
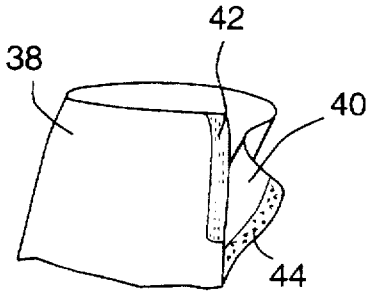
FIG. 7 is a side view of the boot of FIG. 2 showing the relationship of the closable tongue of the boot to the boot upper.

The boots may also include a molded midsole 16. This midsole may be a separate part which is glued or fused to outsole 12 and extends upward partially enclosing the wearer's foot. This midsole may be omitted as a separate part in which case the mold for the outsole 12 should be designed to allow the edge of the outsole to extend up the edge of the boot somewhat, for example half an inch to an inch or so. This "extension" approach rather than the separate midsole design is the preferred design and is shown in FIG. 6 as 12'. This midsole or outsole extension is also molded or constructed of a waterproof plastic or rubber often similar or identical to the material used for outsole 12. As such, it provides thermal insulation and waterproofs the wearer's foot and also provides abrasion resistance and stability.

The midsole or outsole extension is glued or fused to sidewall 18. Sidewall 18 is formed from leather, synthetic leather or some other moldable but abrasion-resistant firm-bodied flexible continuous sheet of support material. Sidewall 18 can completely surround the boot as in the embodiment shown in the FIGS. It also can extend around less than the entire perimeter of the boot for example from the mid ankle area around the toe of the boot and then back around to the mid ankle region of the boot. This sidewall may or may not be waterproof. Its main functions are to provide body and shape to the upper of the boot, to provide impact and abrasion protection to the front portion of the boot and to provide a strong point of attachment for the strapping system which closes the boot. To these ends, sidewall 18 typically extends downwardly and inwardly and is firmly attached by stitching, glue and the like to the sole 12 or 12' and midsole 16 in the area under the wearer's foot. This allows the wearer's weight to help hold the boot together and prevent tearing stresses on the bond between the sidewall and the sole elements.

Sidewall 18 additionally carries slots or apertures 22 and 24 on its medial and lateral surfaces. In the embodiments shown in the FIGS., these apertures are a pair of slots cut in sidewall 18 in medial and lateral positions adjacent to the wearer's transverse arch (i.e across the ball of the wearer's foot). These apertures can be reinforced to accommodate the closing strap. In addition to being formed directly in the sidewall, these apertures 22 and 24 can be formed in separate "eyed" pieces which are attached to the sidewall or to the outsole or midsole in these same positions. The purpose of these apertures is to attach the "Z" closing strap. The boots include a pair of support yokes or struts 26 and 28. These yokes are positioned medially and laterally adjacent to the wearer's ankle. These yokes are most commonly formed out of a structurally strong plastic such as nylon or reinforced polyurethane. They each have a lower region 30 which extends into the sole of the boot under the wearer's foot. The area 30 is glued, nailed and/or stitched into the sole, midsole and/or sidewall. This attachment must be very secure as the yokes provide substantial support to the wearer and carry substantial tension loads when the boot is being worn. These loads arise from tension on the closing straps and can take the form of a preload applied when the boot is being cinched up around the wearer's foot or can take the form of a wearing load applied as the boot is being worn through harsh winter conditions of snow and ice with the various motions of sliding, pushing and pulling and the like. Yokes 26 and 28 are shown affixed into the boot structure between sidewall 18 and sole 12. This location in the multi-layer structure, although preferred, is not considered to be critical. Any position which enables the yokes to become integral solid parts of the boot structure is suitable. In the embodiment shown, the upper end of each of yokes 26 and 28 carries a forward slot or aperture 32 and a rearward slot or aperture 34. These slots are sized to accommodate the closing straps. In an alternative, but not as preferred embodiment, the rear apertures may be omitted and replaced by a connector, such as a molded piece integral with and bridging the two yokes across the back of the boot.

The boot includes an upper 38 with gauntlet tongue 40. This upper is a woven fabric upper with a closed cell foam rubber or plastic insulation backing. It is preferably waterproof or at least water-resistant. It is formed to conform to the wearer's foot and ankle. Seams should be sealed for water resistance, as well. The tongue 40 should tightly close to upper 38 to prevent cold, snow or water from entering the interior of the boot. To this end the tongue and upper should overlap substantially and can each carry some form of closure such as a hook and eye fasteners, hook and loop ("Velcro" brand fasteners) 42 and 44 or the like to allow the tongue to be held closed to the upper. Upper 38 can have a moccasin sewn construction or it can have a board last, whichever style of construction is desired. The boot commonly includes an insole 46 located inside the upper 38.

A woven, knit or felted liner 48 is the last structural piece of the overall footwear system. This liner 48 can be an integral part of the boot and be joined to the sole and/or upper of the boot if desired. Usually, however, it is preferred to form liner 48 as a separate part which is insertable into the finished boot. This allows the wearer to have multiple liners which can be removed, washed, dried and replaced as needed to provide a dry, warm and hygienic environment welcomed by the wearer.

This combination of a boot with a molded outsole (e), a plastic or leather sidewall (d), a closed cell foam-backed fabric (and especially foam-backed fabric) upper (b) with a closable tongue and an insertable liner (a) provides a most advantageous balance of comfort and wearability on the one hand paired with durability and thermal protection and weather protection on the other.

An element to the superior performance of the footwear system of this invention is the strapping which closes the boot and holds the system tight on the wearer's foot. The strapping includes at least one strap and more commonly three or more straps. One strap is a short strap 50 which runs between the back apertures 34 of the yokes 26 and 28. In the embodiment of the invention shown in the FIGS. this strap 50 is shown made of a woven or knit material such as nylon or the like. This strap 50 can include a buckle or other device for adjusting its length to give a suitably tight fit across the back of wearer's heel. As previously noted, in alternative embodiments, the strap 50 can be formed as an extension or integral bridge between the two yokes 26 and 28 or it can be fixed to the two yokes without length adjusting capability.

Figure 2:
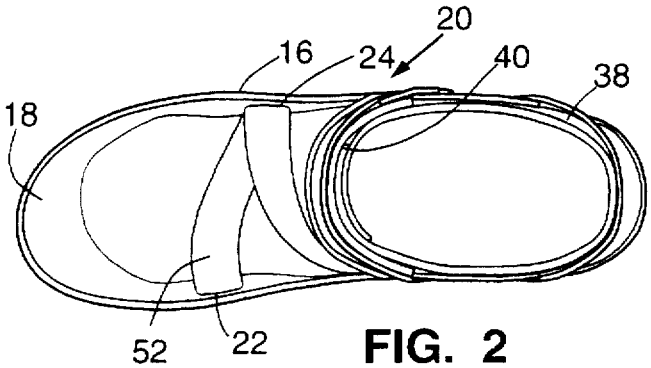
FIG. 2 is a top view of a right foot boot of the invention.

The second strap 52 is always present in the closure system. It is a "Z" strap which runs from medial aperture 22 through lateral aperture 24 back through the front aperture 32 of medial yoke 26 and then to the front aperture 32 of lateral yoke 28. As seen in FIGS. 1 and 2 respectively, this leads to a "reverse Z" configuration for strap 52 on the left boot and a "Z" configuration for strap 52 on the right boot. Strap 52 is equipped with a buckle 54. This buckle is located on the lateral (outside) side of the boot. This minimizes the chances of the buckle being damaged by impact with the other boot when the boot is being warn. It also prevents damage to the upper of the other boot caused by impacts with the buckle. This buckle serves two purposes. For one, buckle 54 allows strap 52 to be released so that the wearer can insert his or her foot into the boot. For another, buckle 54 allows the length of the strap 52 to be adjusted and thus the tightness of the fit to the wearer's foot to be adjusted.

The footwear system also usually includes a third strap 56 which goes around the top of the boot upper and helps close the tongue 40 down onto the upper 38. This strap 56 can take any configuration which will accomplish this closing function. In the embodiment shown in the drawings strap 56 is configured as a single continuous strap attached to the medial side of the upper through guide 58 and to the lateral side of the upper through guide 60 with a buckle 62 connecting the ends of the strap and adjusting the effective length of the strap 56 as needed. Again, the lateral position of buckle 62 is chosen to prevent damage caused by boot-to-boot impacts when the boots are being warn. Alternatively, one could use a strap at the top of the upper which merely bridges between the lateral and medial guides. Also, it is within the purview of the invention to employ more than one strap or closure about the top of the boot upper. Any arrangement of strapping which will comfortably but effectively close the top of the boot upper around the layer.

While this invention has been described with reference to certain particular embodiments, it will be appreciated by those skilled in the art that these embodiments could be modified and adapted and are not to be construed as limiting the scope of the invention defined by the appended claims.

What is claimed is:

1. A winter weather footwear article comprising:

a sole having a top surface and bottom surface;

a flexible and foot-conformable upper attached to the top surface of said sole, said upper comprising a fabric layer and having an exterior surface;

separate lateral and medial struts affixed to opposite sides of the sole and extending upward from the sole adjacent an area which would contact a wearer's ankle when the article is being worn;

separate lateral and medial strap connectors provided on opposite sides of the sole and positioned forward of said struts such that the strap connectors are adjacent to a ball of a wearer's foot when the article is being worn;

a Z strap for tightening the footwear article on a wearer's foot, the Z strap being connected to the medial strap connector, extending from the medial strap connector across the exterior surface of the upper and being connected to the lateral strap connector, extending from the lateral strap connector across the exterior surface of the upper and being connected to the medial strut, and extending from the medial strut across the exterior surface of the upper and being connected to the lateral strut;

a rear strap having a first end portion and a second end portion, the first end portion being connected to the lateral strut and the second end portion being connected to the medial strut such that the rear strap is located adjacent to an area of the upper which would contact across a rearward portion of a wearer's ankle when the article is being worn; and a top strap separate from and above the rear strap and encircling a top of the upper which would contact a portion of a wearer's lower leg above the ankle when the article is being worn.

2. The winter weather footwear article of claim 1, wherein said upper further includes an interior surface with a flexible and foot-conformable layer of foam laminated to the interior surface.

3. The winter weather footwear article of claim 2, wherein the foot-conformable layer is a closed cell polymer foam.

4. The winter weather footwear article of claim 3, wherein the closed cell polymer foam is rubber foam.

5. The winter weather footwear article of claim 3, wherein the closed cell polymer foam is neoprene foam.

6. The winter weather footwear article of claim 1, wherein the sole is a molded sole.

7. The winter weather footwear article of claim 1, including a sidewall affixed to said sole and to said exterior surface of the fabric layer, said sidewall extending upward to a height at least about midway up the side of a wearer's foot when the article is being worn, said sidewall conforming to the fabric layer of the upper and having greater resilience and toughness than the fabric layer and thereby contributing lateral support to the article.

8. The winter weather footwear article of claim 1, wherein the sole is a molded polymer sole.

9. The winter weather footwear article of claim 1, wherein the sole is a molded polyurethane sole.

10. The winter weather footwear article of claim 1, wherein the Z strap is adjustable.

11. The winter weather footwear article of claim 1, wherein the rear strap is adjustable.

12. The winter weather footwear article of claim 1, wherein the top strap is adjustable.

13. The winter weather footwear article of claim 1, wherein the rear strap is a molded piece integral with and bridging across the lateral and medial struts.

14. The winter weather footwear article of claim 1, wherein the rear strap is a knit material.

15. The winter weather footwear article of claim 1, wherein the top strap is openable and surrounds and encloses the top of the upper to allow the top of the upper to be closed to conform to a wearer's leg.

16. The winter weather footwear article of claim 1, wherein the upper comprises:

a vamp that is extendable to permit insertion of the wearer's foot into the footwear article; and a tongue overlying and protecting the vamp.

17. The winter weather footwear article of claim 16, wherein the tongue and the upper include a hook and loop fastener so that the tongue can be fastened down to a front of the upper.

18. The winter weather footwear article of claim 1, wherein the upper is water resistant.

19. The winter weather footwear article of claim 1, further comprising a buckle attached to the Z strap for releasing the Z strap so that a wearer's foot can be inserted into the footwear article.

20. The winter weather footwear article of claim 1, further comprising a sidewall affixed to said exterior surface of the fabric layer and being attached to the sole, the sidewall including said separate lateral and medial strap connectors.

21. The winter weather footwear article of claim 20, wherein the lateral and medial strap connectors are slots in the sidewall.

* * * * *